United States Patent [19]

Rooklyn

[11] 4,456,944

[45] Jun. 26, 1984

[54] TABLE WITH CONDUCTIVE TOP

[75] Inventor: Jack Rooklyn, Northridge, Calif.

[73] Assignee: Industrial Management Company, Chatsworth, Calif.

[21] Appl. No.: 286,611

[22] Filed: Jul. 24, 1981

Related U.S. Application Data

[63] Continuation-in-part of Ser. No. 180,962, Aug. 25, 1980, abandoned.

[51] Int. Cl.[3] ..... H05F 3/02

[52] U.S. Cl. ..... 361/212; 428/83; 428/256; 428/922

[58] Field of Search ..... 428/67, 83, 256, 922; 361/212, 220

[56] References Cited

U.S. PATENT DOCUMENTS

| | | | |
|---|---|---|---|
| 3,311,696 | 3/1967 | Melnick | 428/256 X |
| 3,475,213 | 10/1969 | Stow | 428/344 X |
| 3,505,144 | 4/1970 | Kilduff et al. | 428/344 X |
| 3,652,372 | 3/1972 | Klazkin et al. | 428/45 |
| 3,857,397 | 12/1974 | Brosseau | 361/220 X |
| 4,083,916 | 4/1978 | Chasse | 264/245 |

FOREIGN PATENT DOCUMENTS

| | | | |
|---|---|---|---|
| 2547390 | 5/1977 | Fed. Rep. of Germany | 361/212 |
| 2824245 | 12/1978 | Fed. Rep. of Germany | 174/5 SG |

OTHER PUBLICATIONS

"Velostat", Pamphlet, 6 pp.

*Primary Examiner*—Henry F. Epstein
*Attorney, Agent, or Firm*—Herzig, Schaap & Yanny

[57] ABSTRACT

A table or platform with an improved conductive top adapted for use particularly with small electronic parts. The table or platform includes a normally horizontal top surface. An improvement in one form of the invention is provided by way of stretching a metal screen or mesh material across the top and then filling the mesh with a layer of resin. The resin is ground or sanded off to expose the mesh to provide the conductive top. The conductive top is grounded. Appropriate grounding means are provided to accommodate the grounding. In a second form of the invention the conductive top is provided by way of embedment of metal particles in a plastic layer so as to make the layer conductive. Preferably the table or platform is fabricated by an improved method embodying the placement of plural layers of resin embedding the wire mesh material, screeding, sanding, and polishing to provide a smooth surface wherein the metal of the mesh is exposed.

9 Claims, 5 Drawing Figures

26
14
16
20
38
40
36
35
53
52
34
46
44
WRISTLET
50
30
12
10

SCREEN IMBEDED IN PLASTIC
LIMINATED PLASTIC OPTIONAL
16
14
30
26
12
20
22
10

14
30

TOP SANDED TO EXPOSE SCREEN

MIXED POWDERED METAL/PLASTIC
60
16
12
20
10

26
30
14
16
12
64
66
70
68
22
10

TABLE WITH CONDUCTIVE TOP

This is a continuation-in-part of application Ser. No. 180,962 filed on Aug. 25, 1980 now abandoned.

BACKGROUND OF THE INVENTION

1. Field of the Invention

The field of the invention is that of tables or platforms having a conductive top or surface that can be grounded to drain off static electricity.

2. Description of the Prior Art

Equipment is known in the prior art in the way of tables or platforms having conductive working surfaces which can be grounded. This type of equipment is used in industrial plants where there may be involved many small electronic parts operating on low voltage, such as solid state chips, integrated circuits, etc. Normally there is static electricity present which is sufficiently strong to damage or destroy such a part. Thus, grounding of the working surface is necessary. Static charges may be as high as 5000 volts or higher.

To the extent that conductive tops are known in the prior art, they are relatively expensive and short-lived; further, they are subject to certain deficiencies in not being well adapted for use with small parts which tend to roll off, and the surface often may be too cold to the touch. The tops may not sufficiently smooth to be adequate for their purpose or effective to adequately drain off the static charges.

The invention as described in detail herein provides an improved and more effective conductive surface which overcomes the aforestated deficiencies.

SUMMARY OF THE INVENTION

In a preferred exemplary form of the invention as described herein, it may be constructed utilizing a laminated plastic surface material which may be a conventional surface material utilizing known plastics. The laminated plastic may be already in position on a table top or working surface.

In the practice of the said form of the invention, a metal screen or mesh of appropriate gage is stretched across the top and secured in position. The mesh is then filled with resin which may be any one of various types and then the resin is ground off to expose the mesh. Known types of grinding or sanding techniques can be utilized for grinding off the resin to expose the mesh. For example, a drum sander may be used.

Preferably, a side bracket which may be extruded is secured to the table or working surface to accommodate grounding means. Preferably, the side bracket is extruded aluminum. Normally, when the surface is grounded through an operator, a connection is provided from the side bracket to a wristlet worn by the operator.

In a second form of the invention, electrically conductive powdered metal is mixed with resin in a ratio preferably of two parts metal to one part resin. The mixture is trowelled onto a surface, smoothed and allowed to set.

A preferred method of fabricating the article for commercialization is provided. In a preferred method a grid of wire mesh is stretched across a platform surface and secured taut. A first coat of polyester resin of commercial type containing styrene and a catalyst is trowelled over the wire mesh and screeded off sufficiently to allow the wire mesh to extend slightly above the surface affording a textured surface. The coat of polyester resin is cured to a tacky condition preferably under predetermined conditions of relative humidity and temperature. The time for cure may be 4 hours. For purposes of achieving a superior product a second coat of polyester resin containing styrene and a catalyst and a wax-containing clear liquid is trowelled over the first coat of resin and wire mesh and screeded off allowing the wire mesh to set slightly above the second coat affording a slight textured surface. The second coat is allowed to cure in a similar manner. Some slight indentations may appear in the second coat of polyester resin between the small grid wire mesh which may be present after the first sanding. Too much sanding will penetrate the wire mesh. To fill the slight indentations a liquid epoxy or resin is sprayed over the entire surface filling the indentations and allowed to cure. This final surface is then polished and sanded to a smooth surface with the wire mesh exposed and nearly perfectly flush with the surface.

In the light of the foregoing, the primary object of the invention is to make available an improved and more effective and less expensive but longer lasting conductive table top or working surface adapted particularly for use with small electronic parts.

A further object is to realize a conductive table top as in the foregoing wherein the conductive surface is achieved by way of a method including the steps of stretching a metal screen or mesh across a flat surface; filling the mesh with resin; and then grinding or sanding the resin off so as to expose the mesh.

A further object is to realize an improved conductive table top which comprises a layer of laminated plastic having wire screen or mesh embedded therein, the surface thereof being exposed to provide conductivity with the mesh grounded.

A further object is to realize a conductive table top having improved smoothness and having the capability of dissipating a static charge of 5000 volts or more in 0.001 seconds.

Further objects and additional advantages of the invention will become apparent from the following detailed description and annexed drawings.

DESCRIPTION OF PREFERRED EMBODIMENTS AND BEST MODE OF PRACTICE OF THE INVENTION

Figure 1:
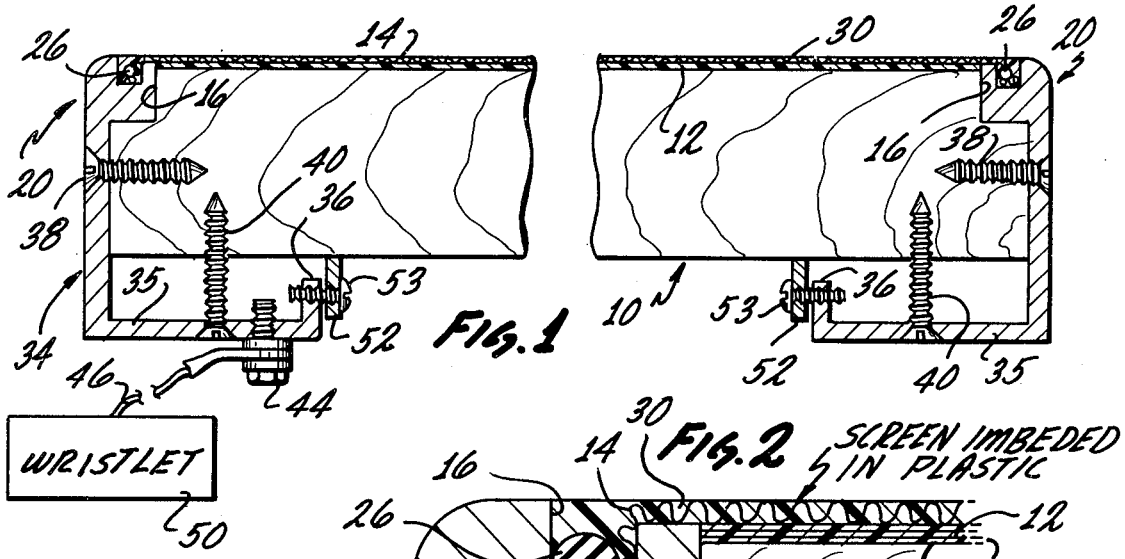
FIG. 1 is a sectional view of a table or platform embodying the invention.
Figure 2:
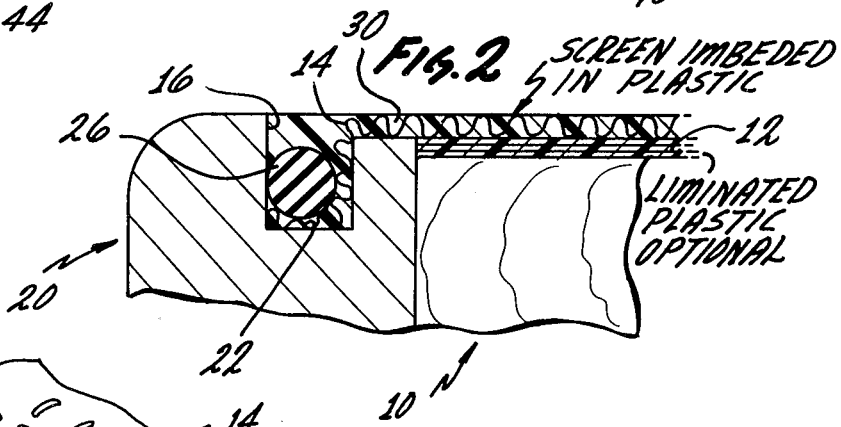
FIG. 2 is a partial sectional view illustrating the securement of the conductive material around the edges of the table.
Figure 3:
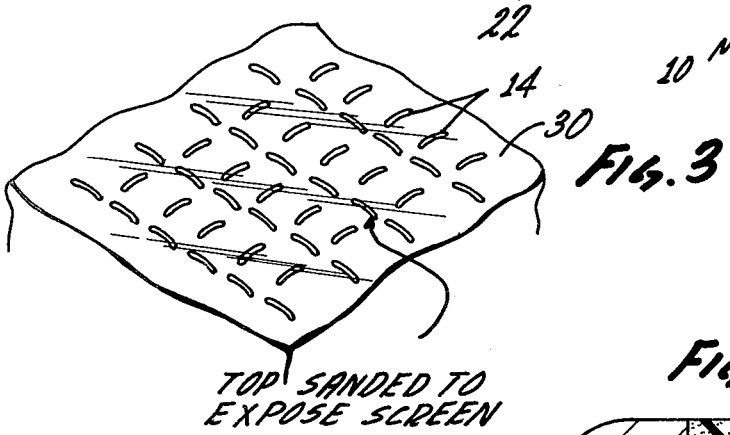
FIG. 3 is a schematic view illustrating the sanding or grinding step in the technique.

Referring now more particularly to FIGS. 1, 2, and 3 of the drawings, an exemplary form of the invention is illustrated. Numeral 10 designates a wooden slab or member of a typical table or platform on which the conductive surface may be provided. A preferred construction is illustrated in more detail in the sectional view, FIG. 2. In this construction, the table or working surface may be one that is originally provided with a laminated plastic surface, as designated at 12 in FIG. 2. It is to be understood, however, that the inclusion of the laminated plastic surface or member is optional since the invention can be practiced without such laminated plastic, as described hereinafter.

Numeral 14 designates a sheet of metal screen or mesh. This screen or mesh can be of various gages, the gage not being critical. Around the top surface of the member 10, there is a square cut out 16 in which is received a frame as designated at 20 to provide means for holding the screen or mesh. The frame may be made entirely of metal or may only include a metal bracket to provide for grounding the metal screen as will be described presently.

As shown, the top of the frame is provided with a continuous groove or channel extending around the sides of the surface as designated at 22. As may be seen, the side edges of the screen or mesh 14 depend into the channel 22 around the four sides as shown. The edges of the screen are held in the channel by way of a member 26 as shown which is circular in cross-section. Preferably, this member may be a continuous flexible member made of rubber or other material which is stretched and which is fit into the channel as shown so as to bear against and hold the edges of the screen. Flexible members of other types may be used.

After positioning the screen or mesh as described and having it held in position, it is then embedded in a resin material as designated by the numeral 30, this material filling the channel 22 on all sides covering the member 26 and the edges of the screen or mesh. The resin is applied in a sufficient amount to fully embed the mesh or screen.

After the resin has set in a smooth layer, the surface is sanded or ground off as illustrated in FIG. 3 sufficiently to expose the metal mesh or screen so that it provides the conductive surface. A drum sander may be used for this purpose.

The frame 20 may be constructed of aluminum and as described it may be a single integral unit extending all the way around the part 10 or it may be constructed in sections suitably secured together. Preferably, the portion designated by the numeral 34 is in the form of a bracket of appropriate width located at a single corner position to provide for grounding of the mesh screen. As shown, it is of angular construction having a horizontal portion 35, at the end of which is an upwardly extending flange or part 36. As shown, it is attached to the part 10 by screws 38 and 40. The bracket may preferably be of extruded aluminum.

Numeral 44 designates a screw or attaching fitting at the end of an electrical lead 46 which connects to a wristlet 50 normally worn by the operator so that the conductive surface is grounded through the operator. The conductive surface is smooth to accommodate small electronic parts. Static charges of 5000 volts or more can be dissipated in 0.001 seconds.

Numeral 52 designates a bracket on the bottom surface of the panel 10 which is attached to the portion 36 by a screw 53, this construction being to accommodate panels 10 of different thicknesses.

As previously indicated, the frame structure 20 may extend entirely around the sides of the panel 10 so that it is similar in cross-section on the right side in FIG. 1 as on the left side. Similar screw attachments may be provided, preferably at the corners.

From the foregoing, it can be seen that a conductive surface is provided which is normally grounded as described through the wristlet and the operator.

Figure 4:
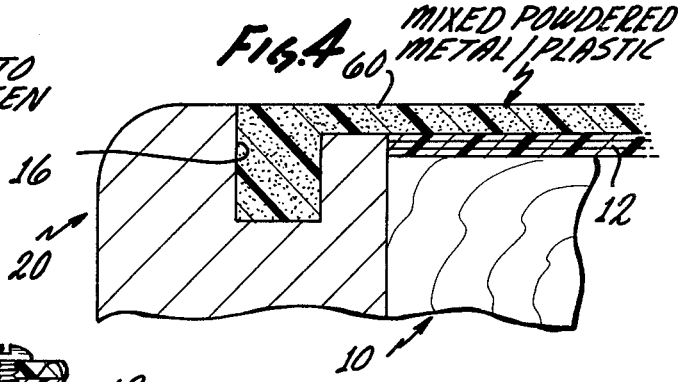
FIG. 4 is a partial schematic sectional view of a modified form of the invention.

FIG. 4 shows a modified form of the invention. In this form of the invention, the metal screen or mesh is not utilized. Instead, a mixture is provided of powdered metal and plastic as designated at 60 which is formed in a layer over the surface, either of the member 10 or the laminated plastic 12 and at the edges it fills the continuous channel 22. Various powders and plastics can be utilized. The powder is of a commercially available type being electrically conductive and of high carbon content. After the mixture of powdered metal and plastic is positioned, such as by trowelling, the top surface is smoothed off to provide the electrically conductive surface. The surface can be grounded in the same manner as described in connection with the previous embodiment.

Figure 5:
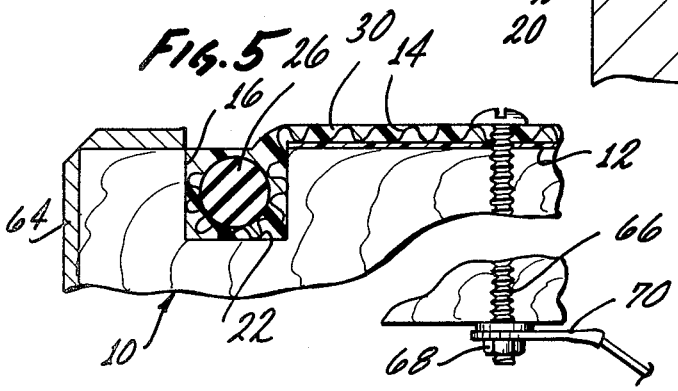
FIG. 5 is a partial sectional view of a modified form of the invention.

FIG. 5 is a partial sectional view of another modified form of the invention. In this form of the invention, there is a sheet of particle board as identified at 10. The top is routed out as indicated at 22 to receive the holding means for the wire mesh screen. Laminated plastic may be provided as shown at 12 with the screen 14 embedded in plastic 30, as in the previous embodiment. The edges of the screen are held in the channel 22 by way of member 26 as in the previous embodiment, the resin material filling the channel 22. Preferably, around the sides and top edges of the board 10 there is provided a laminate which may be of plastic material about 1/32 inch thick as designated at 64. The laminate may have a short flange at the top bent up over the top ledge of the board 10.

The ground connection is made by bolt 66 which extends through the wire mesh material and the particle board with a nut 68 on its end holding electrical terminal of fitting 70.

SPECIFIC EXAMPLE

The following is representative of a specific example of a preferred form of the table that has been fabricated and utilized and which is representative of a specific exemplary form of a method utilized in fabrication. In the specific example, a plain slab of material was utilized with a groove formed closed to the edge and entirely around the perimeter of the slab. A grid made of wire mesh was stretched across the flat surface between the perimeter grooves and secured to taut condition by rolling the wire mesh into the groove. A member referred to as a spline was then rolled into the same groove with the wire mesh securing in a taut permanent condition over the flat surface. The excess wire mesh outside the groove was then trimmed off.

The balance, that is the remainder of the flat surface, not covered by the wire mesh was then masked with masking tape for protection.

A first coat of polyester resin of readily available commercial type containing styrene was mixed with a catalyst and then trowelled over the wire mesh and screeded off sufficiently to allow the wire mesh to extend slightly above the surface thereby affording a textured surface. The catalyst was a readily available commercial type. No inhibitor was used at this time in order to prolong the chemical reaction and retard complete hardening. The first coat of polyester resin was allowed to cure for approximately 4 hours to a tacky condition. The time of cure is variable and can be prolonged or accelerated by the reduction or increase of relative humidity and heat. In the specific example in production for cure of approximately 4 hours the humidity was maintained in a range of 15–25% and temperature in a range of 68°–78° F. The range of humidity and the range of temperature are not critical to the process; the range is given as explanatory of the specific example.

A second coat of polyester resin containing styrene was mixed with the catalyst and wax-containing clear liquid to reduce air sensitivity and inhibition and was then trowelled over the first coat of resin and wire mesh and screeded off allowing the wire mesh to set slightly above the second coat affording a very slight textured surface. The catalyst and clear liquid are readily available commercial products known for this type of purpose. The second coat of resin was then allowed to cure for approximately 4 hours to a completely hard surface. As before the time of cure can be prolonged or accelerated by the reduction or increase of relative humidity and heat. In the specific example, for a complete cure of approximately 4 hours, the humidity was maintained at 15–25% and temperature in a range of 68°–78° F. These ranges as stated before are not critical, but are related to the time of complete cure as explained. This surface is then sanded to a smooth surface exposing the wire mesh near flush with the polyester resin.

At this time some slight indentations may appear in the polyester resin between the small grid wire mesh which will be present after the first sanding. Too much sanding will penetrate the wire mesh. To fill the slight indentations, and epoxy resin in liquid form was then sprayed over the entire surface filling the slight indentations and allowed to cure. Cure time was approximately 2 hours at a humidity of 15–25% and temperature in the range of 68°–78° F. As before the cure may be prolonged or accelerated by the reduction or increase of relative humidity and heat. This surface is then polished, that is sanded, to a smooth surface with wire mesh exposed and near perfectly flush with the surface.

The masking tape is then removed and the surface cleaned; the finished product is then ready for use.

It is significant to point out that the final surface is very smooth with the wire mesh exposed near perfectly flush with the surface. It is, of course important, that the surface be smooth surface otherwise its purpose in having components placed on it will not be achieved. The components may be electronic components containing solid state elements which are operated at very low voltage which could readily be burned out and destroyed simply by the presence of static charges of electricity which may reach as high as 5000 volts. Thus the importance of draining off these charges is apparent.

The herein example of fabrication technique produced the product essentially as illustrated in FIG. 5.

From the foregoing, those skilled in the art will readily understand the nature and construction of the invention and the manner in which it achieves and realizes all of the objectives as set forth in the foregoing.

The foregoing disclosure is representative of a preferred form of the invention and is to be interpreted in an illustrative rather than a limiting sense, the invention to be accorded the full scope of the claims appended hereto.

What is claimed is:

1. As an article of manufacture, a platform having an electrically conductive surface comprising in combination, first means having a generally flat, normally horizontal top area, means providing a smooth continuous electrically conductive surface on said area including a layer of plastic material covering the said surface, metallic means embedded in the plastic material so as to provide electrical conductivity, the said plastic layer having a smooth exposed working surface, the metallic means having exposure to the surface to provide for electrical conductivity of static electricity from a part on the surface through the metallic means, and means for grounding the metallic means whereby to quickly drain off static charge from the platform to protect products placed thereon.

2. An article as in claim 1 including electrically conductive bracket means having engagement with a part of said plastic layer and metallic means and means providing a grounding connection to said bracket means.

3. An article as in claim 1 including means forming a frame, at least part of which is electrically conductive positioned around said first means, said plastic layer containing the metallic means having engagement with said electrically conductive frame.

4. An article as in claim 3 wherein said frame is provided with a continuous groove in its upper surface, an edge portion of said plastic layer being received in said groove.

5. An article as in claim 4 wherein said metallic means includes metallic wire mesh screen embedded in the plastic layer.

6. An article as in claim 5 including a retaining means positioned in said continuous groove and retaining edge portions of said plastic layer and metallic means in the said groove.

7. An article as in claim 1 wherein said metallic means comprisess powdered metal embedded in said plastic layer.

8. An article as in claim 7 including means forming a frame positioned around said first means having at least a part that is electrically conductive, said plastic layer containing the metallic means having engagement with said electrically conductive part of the frame and means for grounding said part.

9. An article as in claim 8 wherein said frame has a continuous groove formed in the surface thereof, an edge portion of the said plastic layer being received in the said groove.

* * * * *